United States Patent [19]

Färber

[11] Patent Number: 5,069,385

[45] Date of Patent: Dec. 3, 1991

[54] CUBOID GABLE PACKAGE WITH A POURING SPOUT ARRANGED IN THE AREA OF A FLAT TOP

[75] Inventor: Jürgen Färber, Kaarst, Fed. Rep. of Germany

[73] Assignee: PKL Verpackungssystems GmbH, Dusseldorf, Fed. Rep. of Germany

[21] Appl. No.: 536,700

[22] Filed: Jun. 12, 1990

[30] Foreign Application Priority Data

Jul. 10, 1989 [DE] Fed. Rep. of Germany ..... 3922648
Nov. 24, 1989 [DE] Fed. Rep. of Germany ..... 3938916

[51] Int. Cl.[5] ..... B65D 5/08

[52] U.S. Cl. ..... 229/137; 206/621.3; 229/242; 220/288; 220/661

[58] Field of Search ..... 229/137, 125.15, 125.42, 229/138; 220/241, 380, 288, 601, 661; 206/621.3

[56] References Cited

U.S. PATENT DOCUMENTS

| | | | |
|---|---|---|---|
| 2,323,505 | 7/1943 | Wilcox | 229/125.42 |
| 3,160,341 | 12/1964 | Cherney | 229/125.42 |
| 3,306,514 | 2/1967 | MacKendrick | 206/621.3 |
| 3,539,076 | 11/1970 | Weiss . | |
| 3,982,683 | 9/1976 | Forteau | 206/621.3 |
| 4,209,092 | 6/1980 | Jones | 229/139 |
| 4,214,675 | 7/1980 | Schmit . | |
| 4,591,091 | 5/1986 | Wise . | |
| 4,657,174 | 4/1987 | Hennig | 206/626 |
| 4,813,578 | 3/1989 | Gordon et al. . | |
| 4,830,273 | 5/1989 | Kalberer et al. | 229/125.42 |
| 4,911,306 | 3/1990 | Lisiecki et al. | 229/137 |
| 4,971,243 | 11/1990 | Lisiecki | 229/125.15 |

FOREIGN PATENT DOCUMENTS

| | | |
|---|---|---|
| 0079560 | 5/1983 | European Pat. Off. . |
| 964860 | 7/1964 | United Kingdom . |

*Primary Examiner*—Stephen P. Garbe
*Assistant Examiner*—Chris McDonald
*Attorney, Agent, or Firm*—Marmorek, Guttman & Rubenstein

[57] ABSTRACT

A cuboid package suitable as a container for a liquid or a food comprises a body formed from a blank of packaging material having a plurality of longitudinal, transverse, and oblique groove lines thereon, said body being shaped into a base, four side walls, a flat top, and gable pocket adjoining one of the side walls and extending under the flat top so that the gable pocket lies within the cuboid outer contour of the body. The gable pocket comprises an inclined surface formed from a re-entrant fold of the blank and lateral pocket surfaces. A pouring spout or an adapter which receives a pouring spount is disposed on the inclined surface of the gable pocket.

20 Claims, 9 Drawing Sheets

Prior Art 87
12
11
13
65
18
125
128
42
41
129
133
55
52
48
36
22
14
43
15
35
47
53
45
34
46
19
54
85
27
32
86
69
26
30
24
10
71
20
57
55
39
62
48
16
75
9
67
23
37
47
40
73
44
56
66
17
P
38
46
58
72
54
33
63
29
76
31
70
21
25
28
8
x

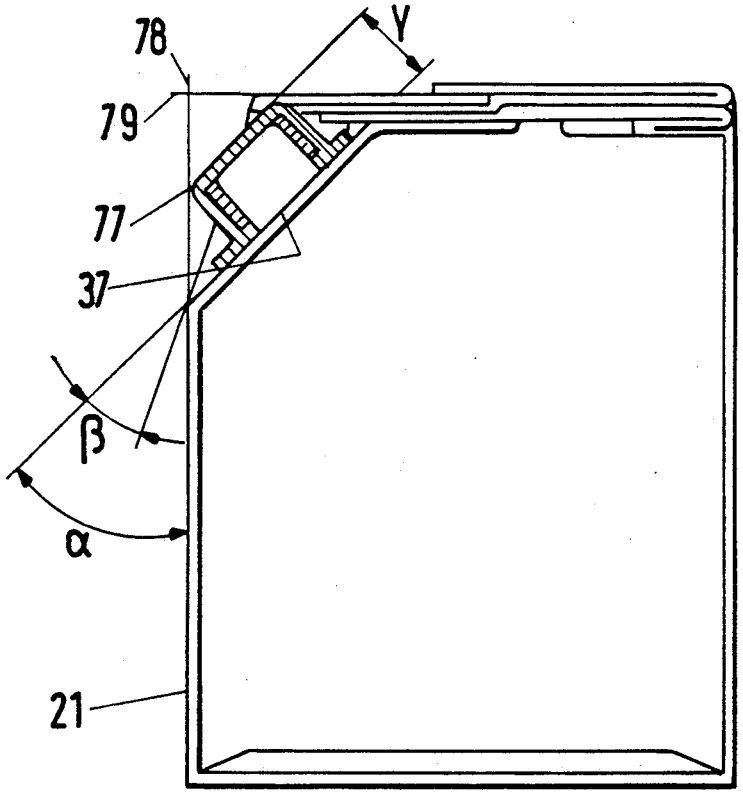
Fig.7
Fig.8
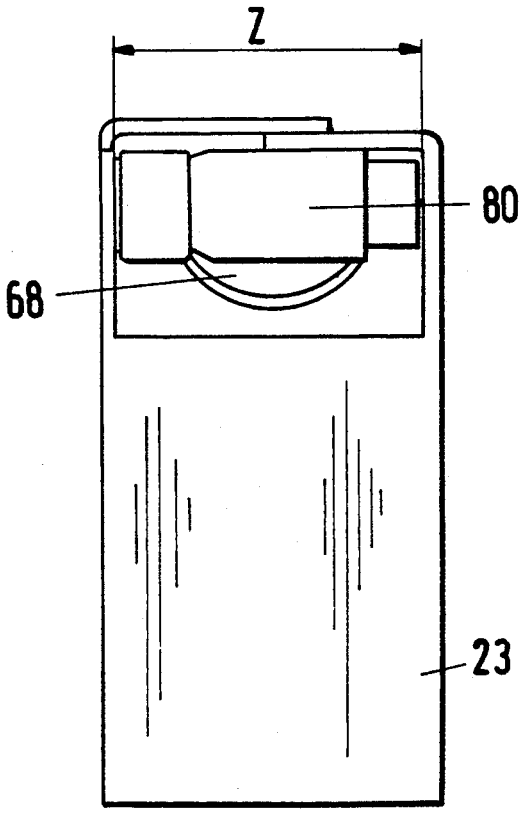

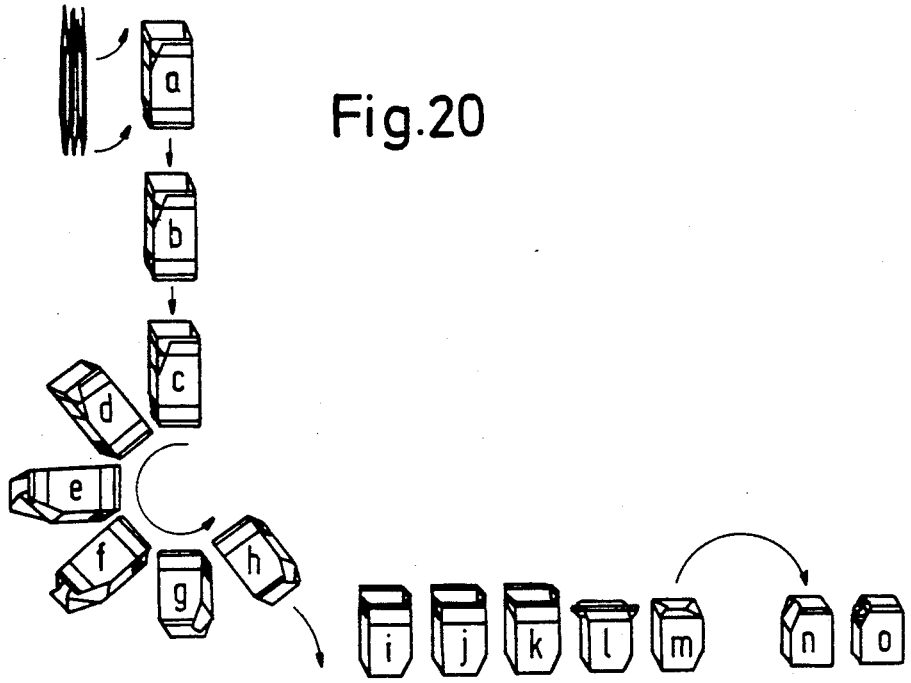
Fig.20
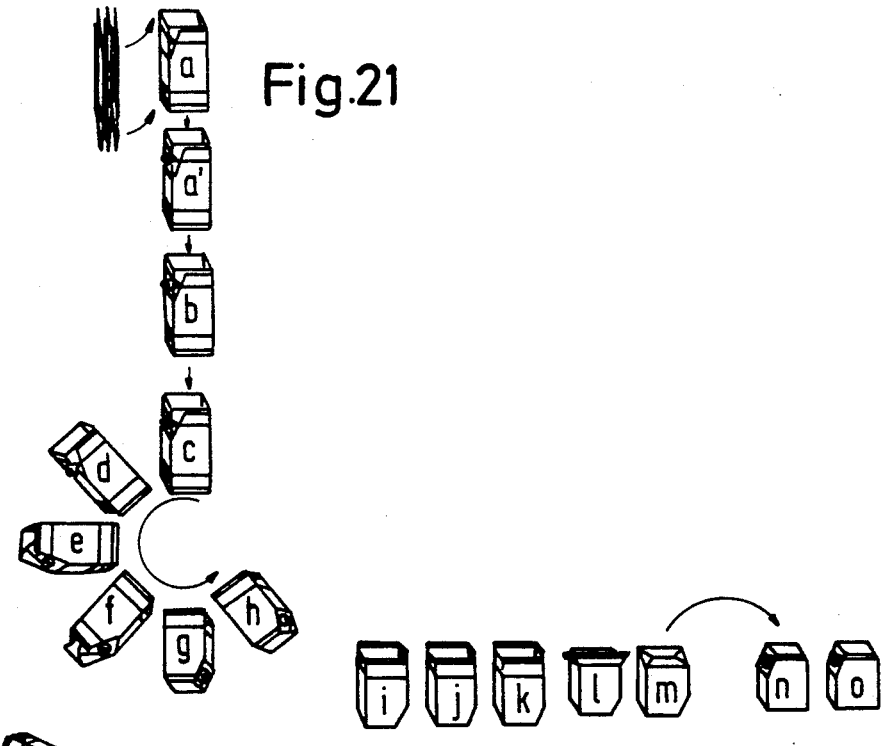
Fig.21
Fig.22
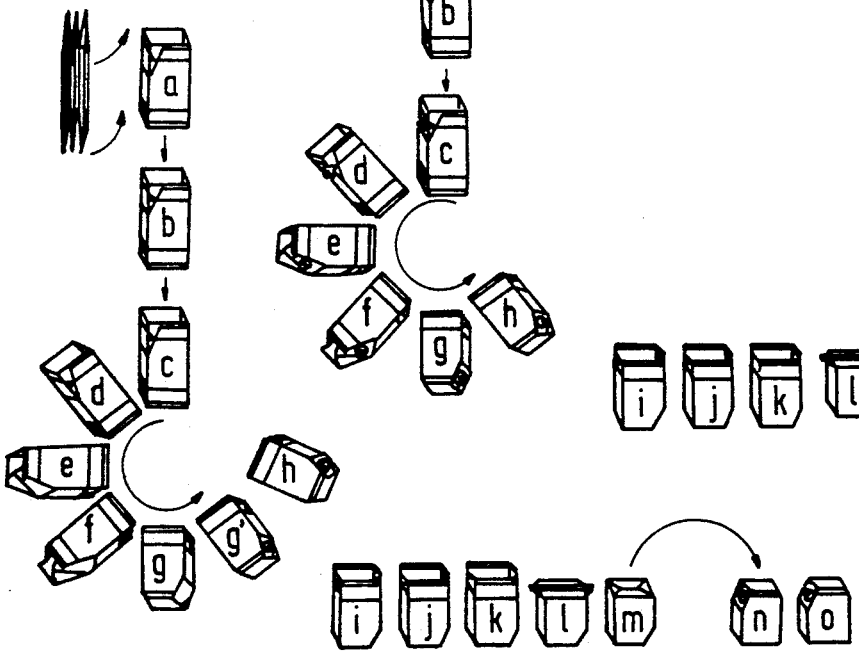

CUBOID GABLE PACKAGE WITH A POURING SPOUT ARRANGED IN THE AREA OF A FLAT TOP

BACKGROUND OF THE INVENTION

The invention relates to a cuboid gable package having a flat top and a pouring spout or an adapter for a pouring spout. More particularly, the invention relates to a folded package made from a plastic multi-layer composite deposited on a supporting material, which package is suitable as a liquid and/or food container. The package is formed by folding a blank or tube of package material along longitudinal, transverse and oblique grooves lines for the body, base and gable edges of the package. The flat top is sealed in the gable area by a web seam and has in one corner area a turned-down fold pocket formed from triangular fold tab areas.

In the liquid and food packaging sector, one-way packages of folded cardboard plastic multi-layer composite have in recent years become well established. Such packages permit optimum space utilization on account of their cuboid shape.

These cuboid packages can be divided essentially into three groups;

1. Cuboid flat-top packages with a six-surface body and body walls which are at right angles and parallel to each other. Such packages, which can be produced in a waste-free manner by folding from rectangular blanks or tube sections, guarantee, in addition to an excellent surface/contents ratio, an optimum pallet accessibility and, on account of the flat top, also an optimum stackability (DE-PS 3,439,102).

2. Cuboid gable packages with a five-surface body with body walls at right angles to each other and a folded-out gable with four gable inclines and a vertical web seam. Such packages cannot in every instance be produced in a waste-free manner and, on account of the vertical web seams, they can only be stacked to a limited extent (EP-0,286,313).

3. Cuboid gable packages with a five-surface body with body walls at right angles to each other and a folded-on gable with four gable inclines and a flat top. Such packages cannot in general be produced in a waste-free manner, but nevertheless they guarantee good stackability (GB-PS 973,801).

With the expansion of the market and the introduction of new product groups, it is desirable to provide such packages with, in addition to the normal opening aids such as perforations and tear tabs, also bottle-like, resealable nozzle openings or pouring spouts, as are available on the market in a variety of forms, for example in connection with cans and containers.

Although, in the case of gable packages with inclined gable surfaces, this object is possible on account of the available clearance within the gable surfaces as far as the web seam, either without problems or without further restriction of the already restricted stackability or without additional stacking space (DE 3,039,299 A1; DE 3,842,412 A1, FIG. 28), in contrast, in the case of flat-top packages, this arrangement inevitably leads to protrusion beyond the body dimensions and to considerable stacking problems (DE 3,832,412 A1, FIG. 27).

Although this protrusion can be kept within limits in the case of flat constructions (see EP 0,018,325 and EP 0,081,011), it nevertheless causes problems during stacking and necessitates more or less elaborate precautionary measures. In addition, because there is only a short stream guide, well-aimed pouring is made difficult.

The invention is based on the object of providing a cuboid gable package of the type mentioned at the outset, in which the pouring spout or an adapter for a pouring spout is arranged on the package in such a way that it does not impair the manageability, of the package, in particular the stackability, and is protected from damage.

SUMMARY OF THE INVENTION

This object is achieved according to the invention by virtue of the fact that, in the corner area opposite the turned-down fold pocket, between the flat top and the adjoining body wall, an inclined surface is arranged. The inclined surface is produced by means of a re-entrant fold and, together with lateral pocket, surfaces bearing on the inside against the adjacent body walls, forms an open gable pocket which lies within the cuboid outer contour of the gable package. A pouring spout or adapter for a pouring spout is located on the inclined surface of the gable pocket.

In the gable package according to the invention, the pouring spout or adapter is not only accommodated within the contour of the cuboid gable package, so that such packages can be arranged and stacked without gaps, but it is also protected by the lateral pocket surfaces and body walls, which form a fold pocket, and by the protruding top area. Despite this protection, the pouring spout or adapter remains easily accessible, because the inclined surface is fairly large, that is to say equal to the width of the adjoining body wall. Requirements for aseptic filling which arise in the case of a packaging material formed from a plastic multi-layer composite material on a support material, namely that there should be no open cut edges facing towards the contents, are satisfied by virtue of the special folding procedure utilized to form the gable package.

It is true that different cuboid liquid packages with a flat top and an inclined surface for the arrangement of a pouring spout are known (U.S. Pat. No. 4,214,675), but in these packages no protection is provided for the pouring spouts. The known package consist of a cuboid container of simple cardboard material with a liquid-proof loose inner bag inserted therein. The problem of the non-open cut edges facing the contents, as in a cuboid gable package of the type according to the invention, thus does not arise here.

In the cuboid gable package according to the invention, the size of the fold or gable pockets laterally delimiting the space for the pouring spout is variable and is limited by the package cross-section, the package height and the fold geometry of the gable folding. Thus, the useful free inclined surface in the gable area ranges in size from a minimum of $\frac{1}{2}\times$the width of the narrow side of the body, to a maximum of the width of the broad side of the body minus $\frac{1}{2}\times$the width of the narrow side of body, while, relative to the narrow side of the body, the useful free inclined surface becomes greater and greater as the angle $\alpha$ formed with the adjoining side decreases, with a practicable angle $\alpha$ of 90°–30°.

90° is for example suitable for an adapter ring for receiving separate pouring spouts, with, on account of the cover-free and single-layer composite, the possibility of easily arranging opening aids, such as, for example, pre-punches and film coverings.

45° for example is suitable for pouring spouts with an optimal diameter and as large a nozzle length as possible.

The site of the inclined surface, where the pouring spout or an adapter ring for a pouring spout is arranged, can be designed and combined in various ways in order to satisfy different requirements. Depending on the contents, there may be a requirement for the pouring spout to have an edge protection both in the unopened and opened condition of the package. In contrast, for various contents there is absolutely no requirement for an edge protection. In order to be able to satisfy these different requirements, according to further embodiments of the invention the inclined surface is provided with an initial scoring. Insofar as the initial punch is situated exclusively on the outside of the inclined surface, then, in the case of a pouring spout sealed-on on the outside, the unopened package has a complete edge protection. In contrast, when the initially punched opening is opened, this edge protection is lost.

If no edge protection is required, then the inclined surface can be provided with a punched-out opening for receiving the pouring spout. However, in the case of a punched-out opening, an edge protection can also be obtained in the unopened package if the edge of the punched-out opening is covered, at least towards the interior of the package, by the inside plastic layer of the plastic multi-layer composite. The edge is preferably covered both by the inside and by the outside plastic layer. A bilateral covering also provides an edge protection for the opened package. The inside plastic layers or the inside and the outside plastic layer covering the edge of the punch-out preferably cover(s) the punched-out opening. In this case the pouring spout, as in the case of the initially scored opening, can only be arranged on the outside of the inclined surface. In order to open the package, the plastic layer or the plastic layers must be pierced.

In the case of a punched-out opening, an edge protection can be achieved not only for the unopened package, but also for the opened package, by using a pouring spout which is sealed onto the inside of the inclined surface with a collar. The pouring spout can advantageously be provided with a double collar which is sealed or sprayed onto the inside and outside of the inclined surface.

In contrast to the conventional production stages for cuboid packages, in the package according to the invention the gable formation and sealing are carried out on a mandrel, and the filling of the gable-sealed package via the base with an occluding web seam closure and folded triangular fold tabs on the base. The all-round edge protection interrupted by the re-entrant fold can be produced in a simple manner by means of an appropriate punch-out in the cardboard support material with subsequent coating-over in the extruder, this punching-out and the coating-over preferably being carried out together with the punching-out of the opening for the pouring spout.

The various steps in the production of the package, including its filling, depend partly on the chosen type of opening and pouring spout. In the case where the opening for the pouring spout or adapter is initially scored or punched-out from the outside and is covered by the inside plastic layer, the filling of the package can be carried out both before and after the application of the pouring spout or adapter. In each case it is ensured that there is an edge protection for the closed package. For production-engineering reasons, it is simplest if the pouring spout or adapter is applied to the package filled via the base after closure of the base.

If, in the case of a punched-out opening, an edge protection is required, it is necessary, before filling the package, to seal the pouring spout with a collar onto the inside of the inclined surface. In this respect there are two possibilities, either to seal the pouring spout on before folding-in the inclined surface or to do so after closure of the gable.

Preferred exemplary embodiments of the invention are illustrated in the drawings and are described in greater detail hereinbelow.

BRIEF DESCRIPTION OF THE DRAWINGS

In the drawing:

FIG. 8: shows a view of the gable package according to FIG. 4 from the narrow side, equipped with a separate pouring spout applied in the gable pocket, FIGS. 20–22 show, in different sequences and in schematic representation, the method steps necessary for forming, filling and closing a gable package and for applying a pouring spout or an adapter for a pouring spout.

DETAILED DESCRIPTION OF PREFERRED EMBODIMENTS

Figure 1:
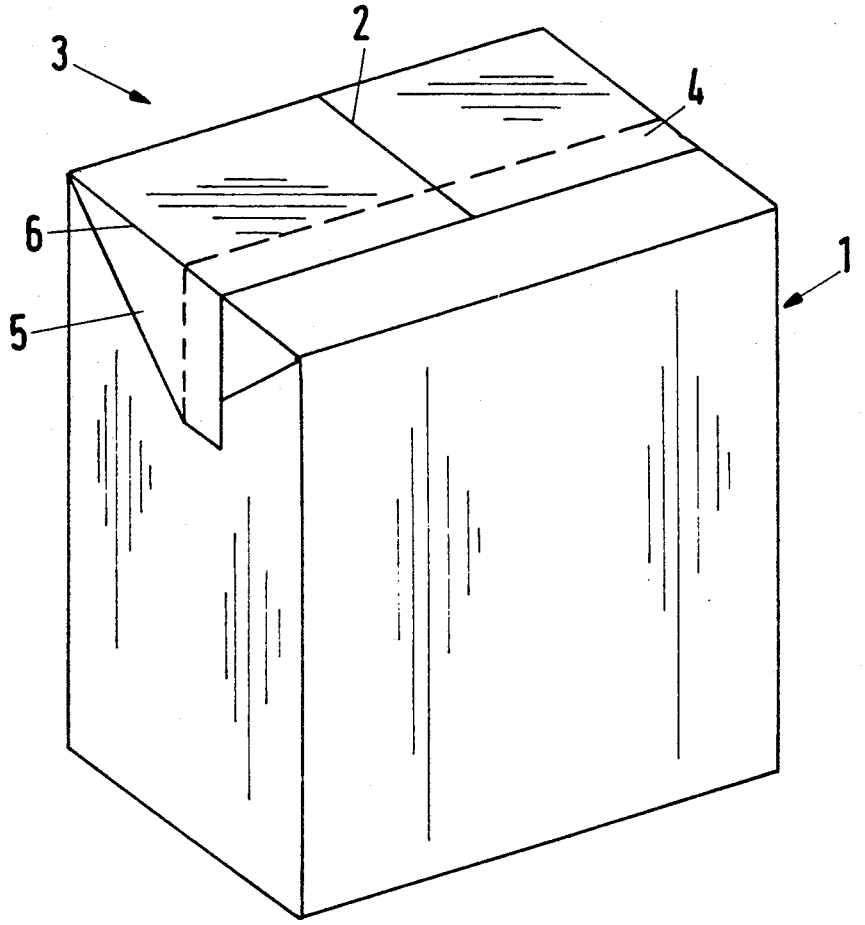
FIG. 1: shows a known gable package with a six-surface body in perspective view.

FIG. 1 shows an embodiment of a known cuboid gable package 1 made from a plastic multi-layer composite deposited on a supporting material and comprising a six-surface body. The body has a length-wise casing seam 2 and a flat top or gable 3, which gable is sealed by means of web seam 4 with formation of two double-lying fold tabs 5 at the end sections of the web seam. In this case each fold tab 5 is turned down over a gable edge 6 outwards onto its respective side wall. The package material has, in a conventional manner, longitudinal, transverse and oblique groove folding lines for forming the body, base and gable edges respectively.

Figure 2:
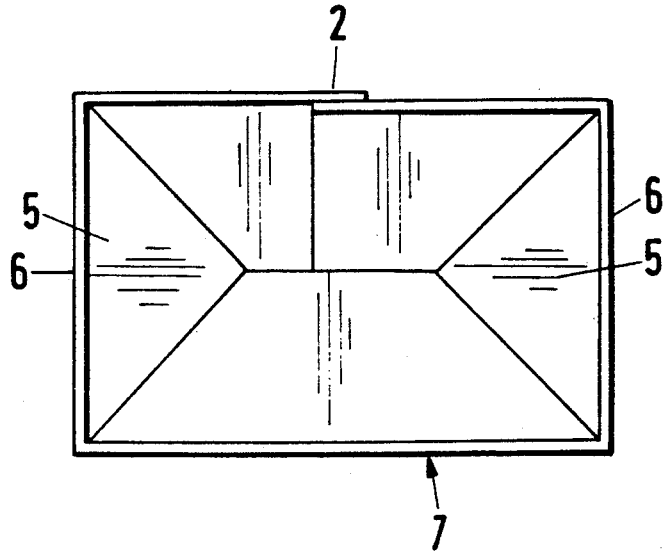
Prior Art Fig.2
FIG. 2: shows a plan view through an open top, of the base of a gable package according to FIG. 1, FIG. 3: shows a flat blank with groove lines and incisions for producing a gable package according to the invention comprising a seven-surface body and a gable pocket in one of the upper corner areas.

FIG. 2 shows the preferred base design 7 for the package according to FIG. 1, in a view through an open top. Base-side triangular fold tabs 5 are here in each case folded inwards over lower edges 6 and are sealed to the base, together with the covered web and base areas, in an overlap fold.

Figure 3:
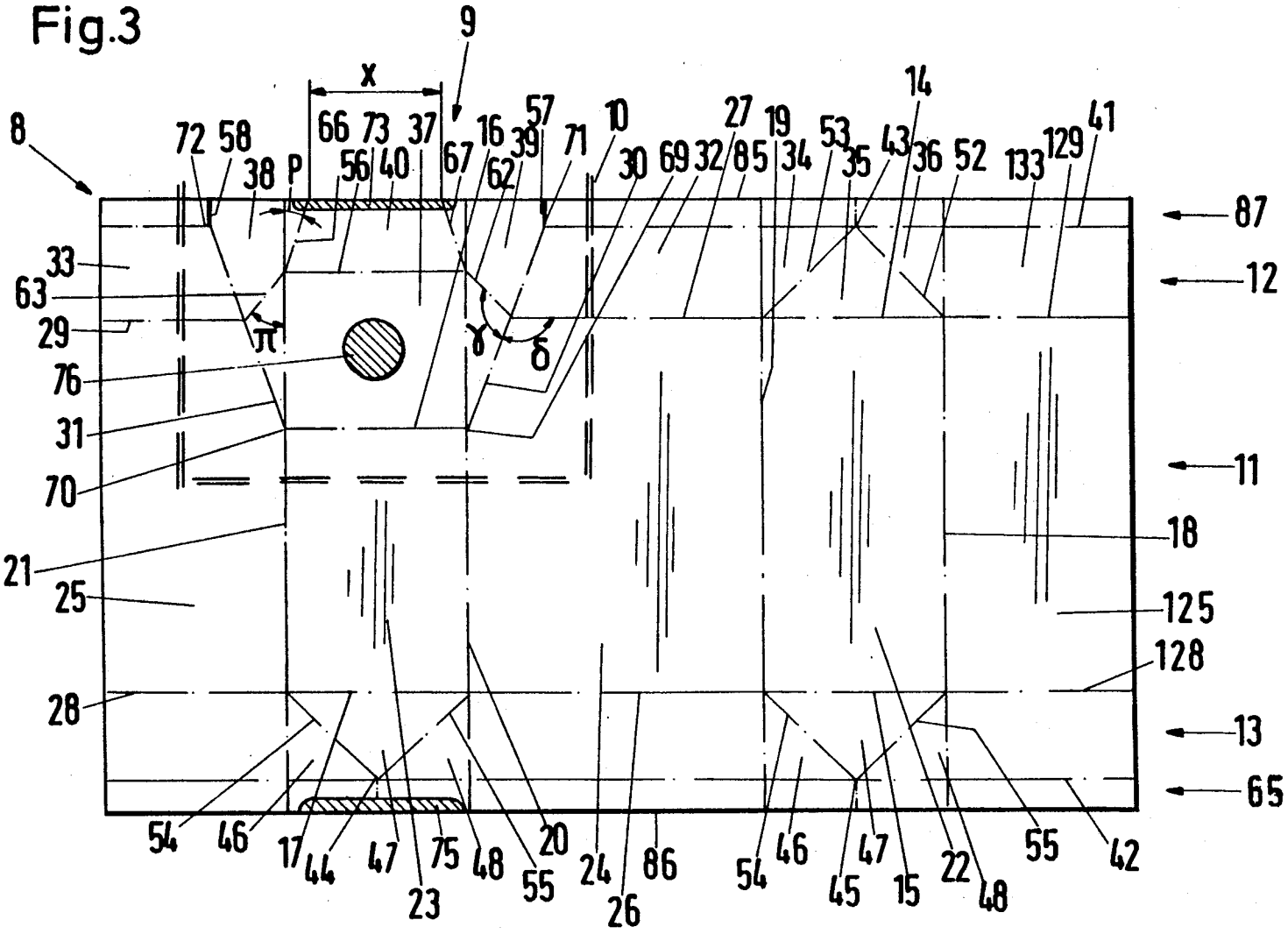

FIG. 3 shows a flat blank 8 with all the features for producing a gable package according to the invention. In this case, the area which is responsible for the folding-out of a gable projection, discussed and illustrated in greater detail below, or an open gable pocket 9, is distinguished from the otherwise identical blank that is used to form the gable package according to FIG. 1.

The rectangular and right-angled blank 8 consists of a middle part, the body area 11, an upper part, the gable area 12, and a lower part, the base area 13.

The body area 11 is delimited by partly slightly projecting horizontal body groove lines 14, 15, 16, 17 and by vertical body groove lines 18, 19, 20, 21 extending in a row over the entire height of the blank.

In this arrangement the body groove lines 14, 15 and 16, 17 delimit the narrow sides 22, 23 of the body, while the broad sides 24, 25/125 of the body are delimited by the interaction of the body groove lines 19, 20, 26, 27 and 18, 21, 28/128, 29/129 with groove lines 30, 31 of the gable pocket 9.

The gable area 12 has gable surfaces 32, 33/133 and triangular fold tab areas 34, 35, 36, an inclined surface area (as seventh surface) 37 and pocket surfaces 38, 39, a flap area 40, and a web seam area 87.

In the upper part of the gable area 12 a web seam base line 41 runs, in the area not included by the re-entrant fold, parallel to an upper blank edge 85 and, correspondingly, in a mirror-image fashion, a web seam base line 42 runs in the lower part of the base area and across the entire base area parallel to a lower blank edge 86, at a comparatively small distance.

These web seam base lines run at the same time through intersection points 43, 44, 45 of oblique groove lines 52, 53, 54, 55 delimiting the upper and lower triangular fold tab areas 34, 35, 36, 46, 47, 48. These groove lines serve for folding and forming the gable area not included by the re-entrant fold to form a gable pocket, as described in FIG. 2 for the package base, and in the base area to form a package base 7 according to FIG. 6.

The re-entrant folds for forming the seventh surface and the gable pocket surfaces 38, 39 covering the latter at least partially is effected via the area indicated in the blank by double lines 10.

The seventh surface (inclined surface 37) is delimited on the one hand by the body groove lines 16, 20, 21 and by a delimiting groove line 56 running parallel to the blank edge 85, while the pocket surfaces 38, 39 are delimited by the vertical body groove lines 20, 21 as well as the groove lines 30, 31 and by cutting lines 57, 58. The insert flap 40 to be sealed in is delimited by the delimiting groove line 56 and the adjoining vertical body groove lines 20, 21. The angle of inclination of the groove lines 30, 31 to the vertical body groove lines 20, 21 is in this case half the size of the angle of inclination of the inclined surface 37 to the narrow side 23.

In order to ensure a stress-free folding, the angle between the groove lines 30, 31 and auxiliary groove lines 62, 63 is the same size as the angle $\delta$ between the groove lines 30, 31 and the horizontal body groove lines 27, 29, and the angle $\rho$ between the vertical body groove lines 20, 21 and further auxiliary groove lines 66, 67 is half the size of the angle $\pi$ between the vertical body groove lines 20, 21 and the auxiliary groove lines 62, 63.

For simplification of the re-entrant fold and for better centering of the fold, the groove lines 30, 31 of the gable pocket line beginning at intersection points 69, 70 between the horizontal body groove line 16 and the vertical body groove lines 20, 21 terminate at intersection points 71, 72 with the web seam base line 41. At this point they merge into the cutting lines 57, 58 which preferably run at right angles to the upper blank edge 85, in which respect, as a result of the incision in the area of the web seam to be turned down by 180°, the turning-down of this tip of the pocket surface and, thus, a warping of the web seam are eliminated.

If, on account of the contents or the packaging type, an all-round edge protection is necessary, which can be achieved in a simple manner for the casing seam area for example by means of a plastic strip or a turned-down web seam, but which is not to be discussed further here, a punch-out 73 is introduced in the upper area of the insert flap 40 in the support material, running parallel to the upper blank edge 85, which punch-out 73 is coated during production of the composite so that there is no open cutting edge towards the inside of the package.

In this respect it has proven advantageous for the punch-out 73 to be longer than the distance x between the auxiliary groove lines 66, 67.

In the case of waste-free blank production, there is inevitably a corresponding punch-out 75 in the base area, which is then cut through during production so that in these sections the blank edge is formed by a pure film composite and the contents cannot soak into the support material.

To receive pouring spouts or opening aids, the inclined surface 37 is provided with initial scores and/or punch-outs 76, which facilitate the attachment of objects or the opening of the package.

Figure 4:
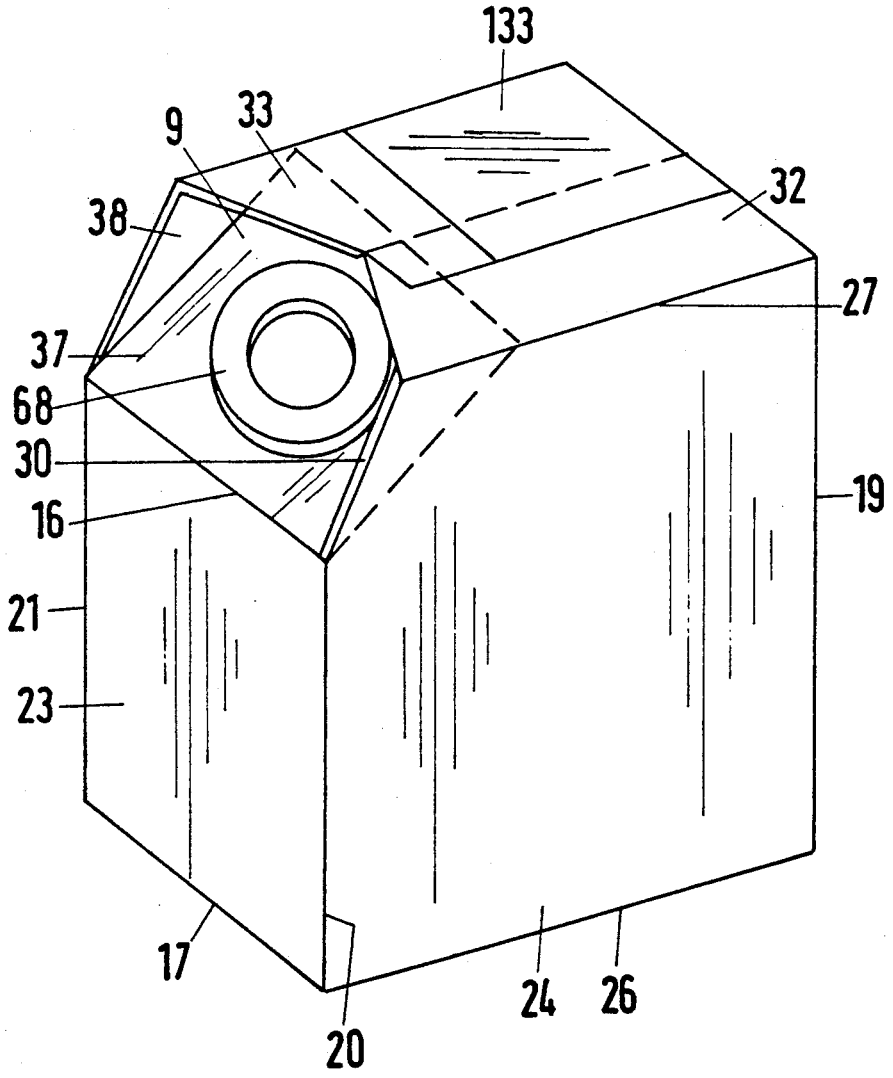
FIG. 4: shows a gable package produced from a blank according to FIG. 3, with an adapter ring in the gable pocket.

FIG. 4 shows a perspective view of a package made from the blank 8 and sealed to form a casing. The body groove lines here appear as body edges and are therefore designated by the same numbers.

The inclined surface 37 is reproduced with a broken line in its area covered by the body surfaces, so that the protrusion of the lateral pocket surfaces 38, 39 and the gable surfaces 32, 33 for forming the open gable pocket 9 is clear. An adapter ring 38 is applied on the inclined surface 37.

FIG. 20 shows a plan view through an open base, of the top or gable of a package according to FIG. 4. In this drawing, both the folding-in of the triangular fold tab 35 and the arrangement of this fold tab 35 with respect to the insert flap 40 and to the inclined surface are clear.

Figure 6:
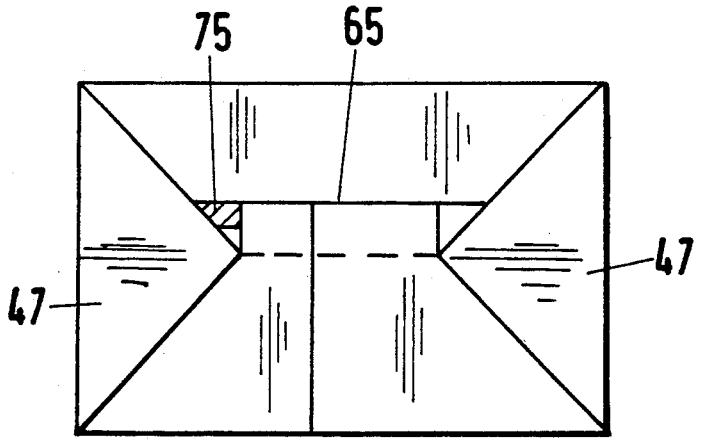

FIG. 6 is a plan view of the base of a package according to FIG. 4 which is sealed at the base with the triangular fold tabs 47 folded down onto the base and sealed on, as well as the edge protection 75 of the base-side web seam 65 which is partially not sealed into the base fold.

FIG. 7 shows a cross-section through a gable package according to FIG. 4, equipped with a sealed-on, resealable pouring spout 77. The pouring spout 77 lies within the contour of the package, as shown by lines 78, 79. In this way a flat, protrusion-free stacking of the package is ensured.

It can also clearly be seen from FIG. 7 that the angle of inclination $\beta$ of the package edge predetermined by the groove line of the gable pocket 9 is half the size of the angle of inclination $\alpha$ of the inclined surface 37.

FIG. 8 shows a view of a gable package according to FIG. 4 from the narrow side 23, with an adapter ring 68 applied in the gable pocket with a resealable separate pouring spout 80.

Figure 9:
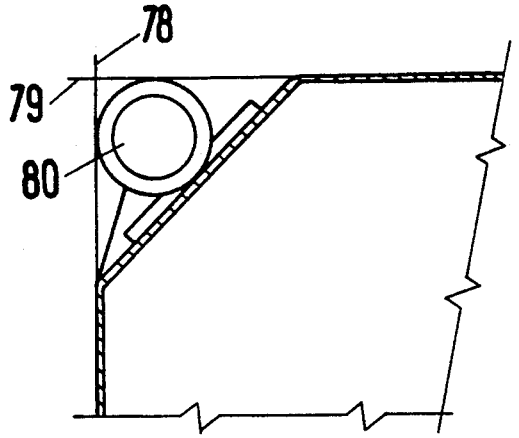
FIG. 9: shows a cross-section through the gable pocket according to FIG. 8, FIG. 10: shows a cross-section through the gable pocket as in FIG. 9, but with a ready-to-use separate pouring spout inserted.

FIG. 9 shows a cross-section through the gable pocket 9 equipped with a separate pouring spout 80 and an adapter ring 68.

Figure 10:
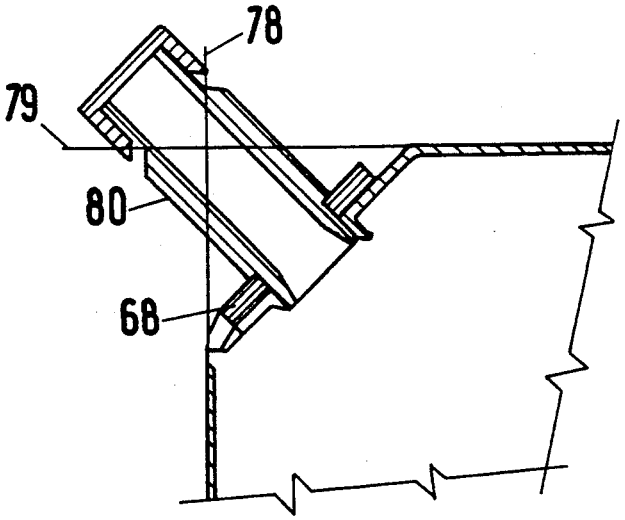

FIG. 10 shows the separate pouring spout 80 in the position of use inserted into the adapter ring 68 and locked on the latter.

From FIGS. 8 to 10 it can be seen that the adapter ring 68 and the separate pouring spout 80 lie within the body contour 78, 79 when sold, but that the separate pouring spout, in the ready-to-use arrangement, projects far beyond this contour. As a result of this, on account of the stream being guided in the long nozzle, a well-aimed pouring out is possible, since the length of the nozzle of the separate pouring spout is determined not, as in the arrangement according to FIG. 7, by the height y and/or by the cross-section of the gable pocket, but, as shown in FIG. 8, by the width z of the gable pockets 9, that is to say by the width t of the narrow side 23.

Figure 5:
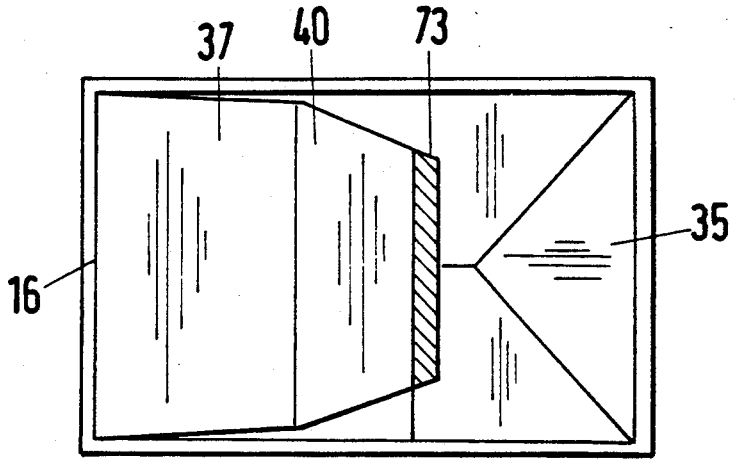
FIG. 5: shows a plan view through an open bottom, of the top of a gable package according to FIG. 4, FIG. 6: shows a plan view of the base of the gable package according to FIG. 4, FIG. 7: shows a cross-section through the gable package according to FIG. 4, equipped with a resealable pouring spout applied to the gable pocket.
Figure 11:
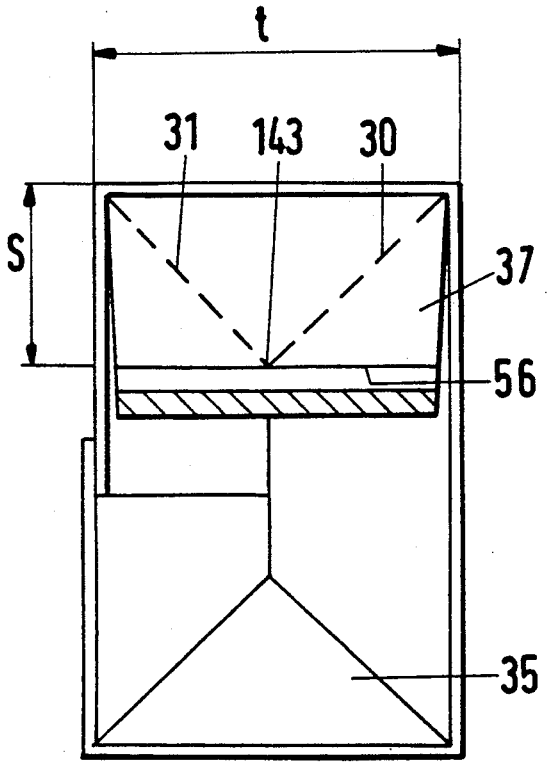
FIG. 11: shows a plan view through an open base, of the top of a package as in FIG. 5, but with a minimum useful inclined surface in the gable area equal to $\frac{1}{2}\times$the width of the narrow side.

FIG. 11 shows a view through an open base of a gable of a package, as in FIG. 5, but with the minimum useful inclined surface S equal to $\frac{1}{2}\times$the narrow side width t. It emerges clearly from FIG. 11 that in this case the delimiting groove line 56 meets the groove lines 30, 31 at the intersection point 143, which in this case is identical to the intersection point of the oblique groove lines 52, 53.

Figure 12:
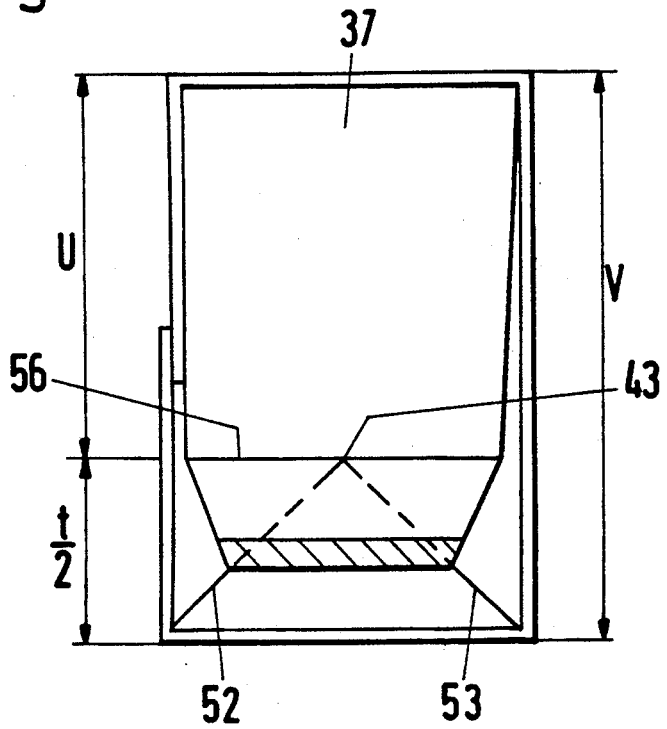
FIG. 12: shows a plan view through an open base, of the top of a package as in FIG. 5, but with a maximum useful inclined surface in the gable area equal to the width of the broad side minus $\frac{1}{2}\times$the width of the narrow side.

FIG. 12 shows a view through an open base of a gable of a package, as in FIG. 11, but with the maximum useful inclined surface u equal to the broad side width v minus $\frac{1}{2}\times$the narrow side width t. It emerges clearly from this that in this case the delimiting groove line 56 meets the intersection point 43 of the oblique groove lines 52, 53 delimiting the triangular fold tabs. That is to say, the useful inclined surface 37 is delimited on the one hand by the horizontal base groove line 16 and by the delimiting groove line 56, in which respect the base groove line 16 can lie at the level between the base body edge 17 and the gable body edge corresponding to the edge 14, and the delimiting groove line 56 between the intersection points 143 and 43.

In this way, in gable packages, the inclined surface affords the formation of a seventh surface and, thus, also an opening across the whole width of the narrow side in a single-layer composite.

Figure 13:
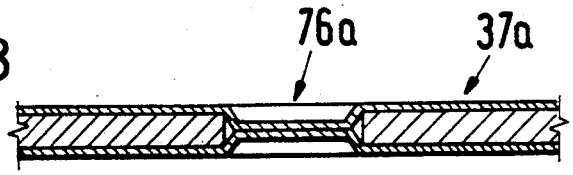
FIGS. 13–15 show an initially scored or punched-out opening for a pouring spout or an adapter for a pouring spout on the inclined surface in the gable area in various embodiments.

In the case of the inclined surface 37*a* represented in FIG. 13, the cardboard support material is punched out in order to form an opening 76*a* for a pouring spout. The punched-out opening 76*a* is covered by a subsequent, two-sided coating.

Figure 14:
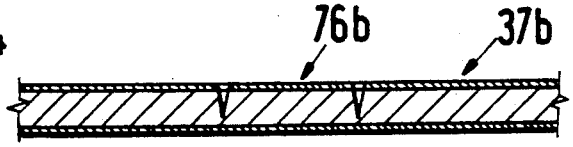

In the exemplary embodiment in FIG. 14, an initially scored opening is provided in the inclined surface 37*b* of the gable area in order to form an opening 76*b* for a pouring spout, in which case the inside plastic covering is undamaged.

Figure 15:
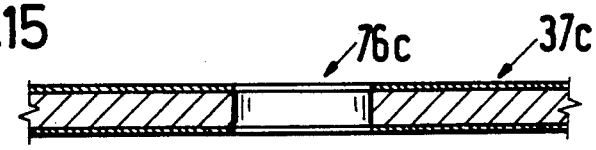

In the exemplary embodiment in FIG. 15, a through-opening 76*c* is punched out in the inclined surface 37*c* of the support material coated on both sides.

For all three types of openings, depending on the pouring spout used, an edge protection is obtained both when the opening is sealed and also when it is opened.

Figure 16:
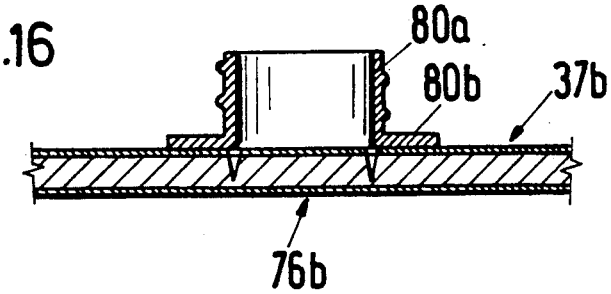
FIGS. 16–19 show a pouring spout, sealed onto the opening in the inclined surface, in cross-section and in various embodiments.

In the exemplary embodiment in FIG. 16, a pouring spout 80*a* with a collar 80*b* is sealed onto the outside of the inclined surface 37*b*, in which the initially scored opening 76*b* is provided. In this case, an edge protection is present only as long as the initially scored opening 76*b* is not pierced.

Figure 17:
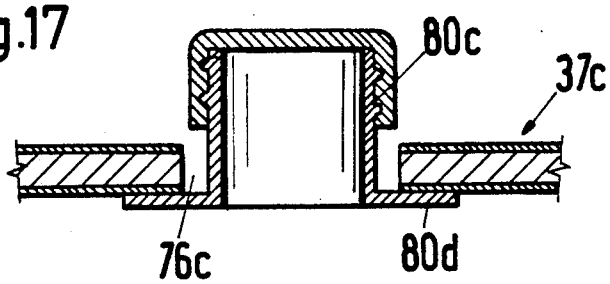

In the exemplary embodiment in FIG. 17 with the punched-out opening 76*c*, a complete edge protection is afforded, since the pouring spout 80*c* is sealed with its collar 80*d* onto the inside of the inclined surface 37*c*.

Figure 18:
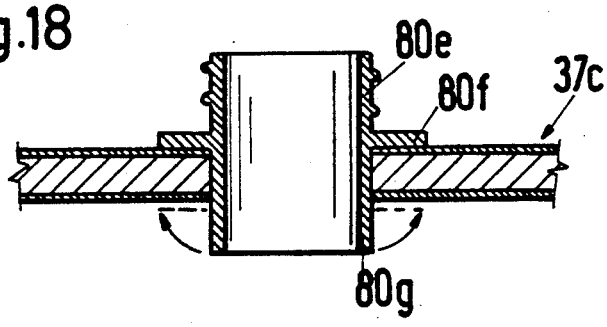

In the exemplary embodiment in FIG. 18, a complete edge protection is again afforded. In this case the pouring spout 80*e* is sealed with a double collar 80*f*, 80*g* both onto the outside and onto the inside of the inclined surface 37*c*.

Figure 19:
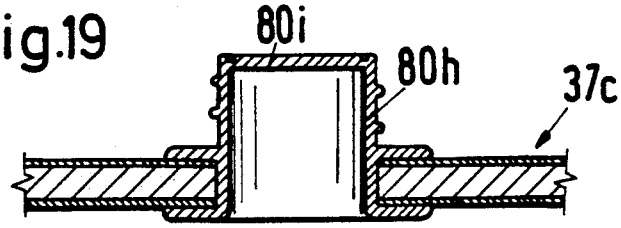

The exemplary embodiment in FIG. 19 corresponds to that in FIG. 18, with the one difference that in this case the pouring spout 80*h* is sprayed on and is sealed by means of a membrane 80*i* produced during the spraying procedure and designed to be perforated.

FIG. 20 shows the method steps of a preferred embodiment for the production and filling of a gable package according to the invention, namely a) the folding open of the casing or tube section, sealed with a longitudinal seam, to give a tube which is open at both ends at the base and at the gable,
b) the pre-sterilization of the open tube (only in the case of aseptic filling),
c) the pushing of the tube onto a forming mandrel,
d) the activation of the gable areas with hot air or direct heating,
e) the folding-in of the inclined surface and the further activation of the gable areas,
f) the folding-in of the triangular fold tabs,
g) the folding-over of the web seam and the sealing of all the gable surfaces,
h) the transfer into a cell,
i) the preliminary folding of the package base,
j) the subsequent sterilization of the gable-sealed package (only in the case of aseptic filling),
k) the filling of the package via the package base,
l) the folding and sealing of the package base via a web seam by means of high-frequency, ultrasonics, hot-air, radiation, or heat impulses,
m) the turning-down and sealing-on of the triangular fold tabs onto the base of the body,
n) the turning over of the package from the direction in which it is standing on its gable to the direction in which it is standing on its base,
o) the application of a pouring spout or adapter ring to the inclined surface, in the case of an initially punched or punched-out opening covered by at least one inside plastic layer, before or after filling, in particular after closure of the base, or, in the case of a punched-out opening which is not covered, before filling, in particular before folding-in the inclined surface and in particular after closure of the gable.

The exemplary embodiment in FIG. 21 differs from that in FIG. 20 in that the pouring spout is not arranged on the filled package (a), but already on the folded package (a'). Therefore, unlike the exemplary embodiment in FIG. 20, in this exemplary embodiment the inclined surface 37 does not need to be sealed at the position determined for the opening, as is shown for example in FIGS. 13 and 14. Since the seal is applied before the filling (k), an edge protection can be better achieved.

In the exemplary embodiment in FIG. 22, the seal is arranged only after completion (g') of the gable but, as in the previous exemplary embodiment, before filling (k). The advantages with regard to the edge protection are therefore the same.

I claim:

1. A cuboid gable package suitable for holding a liquid or a food, said package comprising a hollow container formed from a blank of packaging material made from a plastic multi-layer composite deposited on a supporting material, said container comprising a base, first and second oppositely disposed narrow sidewalls, first and second oppositely disposed broad sidewalls, and a flat top, said container being configured to have a substantially cuboid outer contour, a web seam which seals said flat top, said container further comprising a gable pocket adjoining said first narrow sidewall and extending under a first end of said flat top so that said gable pocket lies within the cuboid outer contour of said container, said blank having a plurality of longitudinal, transverse and oblique groove lines which form edges of said base, said narrow and broad sidewalls, said flat top, and said gable pocket, said gable pocket comprising an inclined surface formed from a re-entrant fold of said blank and lateral pocket surfaces disposed between said first narrow sidewall and said first and second broad sidewalls, and non-integral pouring means disposed on and passing through said inclined surface of said gable pocket for enabling a liquid or food to be poured out of said package.

2. The gable package of claim 1 wherein said pouring means comprises a pouring spout.

3. The gable package of claim 1 wherein said pouring means comprises an adapter which receives a pouring spout.

4. The gable package of claim 1 further comprising a turned-down fold pocket at a second end of said flat top, said fold pocket being formed from a triangular fold tab area of said blank.

5. The gable package of claim 1 wherein said inclined surface is delimited by first and second vertical groove lines of said blank which also serve as first and second vertical body groove lines of said first narrow sidewall, and first and second horizontal groove lines on said first narrow sidewall and which are offset from first and second horizontal body groove lines delimiting said first narrow sidewall.

6. The gable package of claim 1 wherein said gable pocket is at least partially delimited by wall parts which protrude beyond said inclined surface onto said first and second broad sidewalls.

7. The gable package of claim 6 wherein said protruding wall parts are delimited by additional groove lines which extend from said first narrow sidewall onto said flat top.

8. The gable package of claim 7 wherein said additional groove lines comprise continuous oblique groove lines extending from said first horizontal groove line on said first narrow sidewall and running through said first and second broad sidewalls and said flat top, vertical incision lines, and first and second sets of auxiliary groove lines extending from said oblique groove lines.

9. The gable package of claim 8 wherein an angle $\gamma$ formed between said oblique groove lines and said first set of auxiliary groove lines is substantially equal to an angle $\delta$ formed between said oblique groove lines and horizontal body groove lines formed on said first and second broad sidewalls, and an angle $\rho$ formed between said first and second vertical body groove lines of said first narrow sidewall and said second set of auxiliary groove lines is substantially one-half of an angle $\pi$ formed between said first and second vertical body groove lines of said first narrow sidewall and said first set of auxiliary groove lines.

10. The gable package of claim 9 further comprising an insert flap adjoining said second horizontal groove line delimiting said inclined surface, said insert flap being sealed within said gable package.

11. The gable package of claim 10 further comprising first and second punched-out areas arranged on first and second edges of said first narrow sidewall, the width of said first and second punched-out areas being greater than the narrowest distance between said first set of auxiliary groove lines.

12. The gable package of claim 1 wherein said blank includes a score line for receiving said pouring means on said portion of said first narrow sidewall to be formed into said inclined surface.

13. The gable package of claim 12 wherein said score line is located exclusively on an exterior portion of said inclined surface.

14. The gable package of claim 1 wherein said inclined surface is provided with a punched-out opening for receiving said pouring means.

15. The gable package of claim 14 wherein an edge of said punched-out opening is covered by an inside plastic layer of said plastic multi-layer composite.

16. The gable package of claim 15 wherein said edge of said punched-out opening is covered by said inside and an outside plastic layer of said plastic multi-layer composite.

17. The gable package of claim 16 wherein said plastic multi-layer composite covers over the punched-out opening.

18. The gable package according to claim 1 wherein said pouring means comprises a pouring spout sealed onto an outside portion of said inclined surface.

19. The gable package of claim 1 wherein said pouring means comprises a pouring spout sealed onto an inside portion of said inclined surface with a collar.

20. The gable package of claim 1 wherein said pouring means comprises a pouring spout sealed onto inside and outside portions of said inclined surface with a double collar.

* * * * *